US006951509B1

(12) United States Patent
Palmgren

(10) Patent No.: US 6,951,509 B1
(45) Date of Patent: Oct. 4, 2005

(54) UNDULATED PAD CONDITIONER AND METHOD OF USING SAME

(75) Inventor: Gary M. Palmgren, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/797,892

(22) Filed: Mar. 9, 2004

(51) Int. Cl.[7] ..... B24B 1/00
(52) U.S. Cl. ..... 451/56; 451/443
(58) Field of Search ..... 451/56, 443, 444, 451/490, 548, 549, 550, 495; 438/692, 693

(56) References Cited

U.S. PATENT DOCUMENTS

| | | | |
|---|---|---|---|
| 907,862 | A | 12/1908 | Nicholls |
| 2,990,661 | A | 7/1961 | Hackett |
| 3,110,140 | A | 11/1963 | Reames |
| 4,652,275 | A | 3/1987 | Bloecher et al. |
| 4,799,939 | A | 1/1989 | Bloecher et al. |
| 5,014,468 | A | 5/1991 | Ravipati et al. |
| 5,152,917 | A | 10/1992 | Pieper et al. |
| 5,453,312 | A | 9/1995 | Haas et al. |
| 5,454,844 | A | 10/1995 | Hibbard et al. |
| 5,458,532 | A | 10/1995 | Cannone |
| 5,500,273 | A | 3/1996 | Holmes et al. |
| 5,531,635 | A | 7/1996 | Mogi et al. |
| 5,578,362 | A | 11/1996 | Reinhardt et al. |
| 5,692,950 | A | 12/1997 | Rutherford et al. |
| 5,820,450 | A | 10/1998 | Calhoun |
| 5,897,424 | A | 4/1999 | Evans et al. |
| 5,958,794 | A | 9/1999 | Bruxvoort et al. |
| 6,093,085 | A | 7/2000 | Yellitz et al. |
| 6,123,612 | A | 9/2000 | Goers |
| 6,190,243 | B1 | 2/2001 | Wada et al. |
| 6,194,317 | B1 | 2/2001 | Kaisaki et al. |
| 6,217,426 | B1 | 4/2001 | Tolles et al. |
| 6,220,942 | B1 | 4/2001 | Tolles et al. |
| 6,263,605 | B1 | 7/2001 | Vanell |
| 6,312,319 | B1 | 11/2001 | Donohue et al. |
| 6,325,702 | B2 | 12/2001 | Robinson |
| 6,361,423 | B2 * | 3/2002 | Gurusamy et al. ..... 451/443 |
| 6,413,873 | B1 | 7/2002 | Li et al. |

(Continued)

FOREIGN PATENT DOCUMENTS

| | | |
|---|---|---|
| WO | WO 02/28596 A1 | 4/2002 |
| WO | WO 03/058691 A1 | 7/2003 |

OTHER PUBLICATIONS

Product Literature: Letter re "Max-Grip DA Hook Pad," Plymouth Products, Dec. 1, 2000, 2 pages.
Product Literature: Letter re "Improved Circle Cool Pad and New Adjustable Spanner Wrench," Plymouth Products, Dec. 1, 2000, 2 pages.
Product Literature: Letter re "Phenolic Plate Sets," "Phenolic Plates," "Sav-A-Disc," Plymouth Products, Dec. 1, 2000, 3 pages.
Product Literature: Letter re "Abrasive Disc Cutter," "Poly Pads," "Polishing/Buffing Pads," "Rib Faced Rubber Pads," "Smooth Faced Rubber Pads," Plymouth Products, Dec. 1, 2000, 3 pages.
Price List: Plymouth Products, Jan. 1, 2001, 2 pages.

*Primary Examiner*—Dung Van Nguyen
(74) *Attorney, Agent, or Firm*—Daniel D. Biesterve

(57) ABSTRACT

A pad conditioner having an abrasive disk and an undulating disk and methods for using the same. The undulating disk has at least one raised portion and at least one recessed portion. The abrasive disk is releasably affixed to at least a portion of the recessed portion to form an undulated abrasive surface. The undulating disk allows the pad conditioner to be modified for use with multiple processes and for a variety of workpieces.

20 Claims, 4 Drawing Sheets

U.S. PATENT DOCUMENTS 6,491,843 B1 12/2002 Srinivasan et al.
6,498,101 B1 12/2002 Wang
6,508,697 B1 * 1/2003 Benner et al. ..... 451/443
6,520,834 B1 2/2003 Marshall
6,575,825 B2 6/2003 Tolles et al.
6,592,438 B2 7/2003 Tolles et al.
6,612,917 B2 9/2003 Bruxvoort
6,632,129 B2 10/2003 Goetz
6,648,731 B2 11/2003 Shin
6,712,679 B2 3/2004 Taylor et al.
2002/0077037 A1 6/2002 Tietz
2002/0142601 A1 10/2002 Boyd et al.
2003/0022598 A1 1/2003 Mullenburg et al.
2003/0027504 A1 * 2/2003 Shipley et al. ..... 451/56
2004/0053566 A1 3/2004 Tolles et al.
2004/0072518 A1 4/2004 Prabhu et al.
2005/0032462 A1 2/2005 Gagllardi et al.

* cited by examiner

UNDULATED PAD CONDITIONER AND METHOD OF USING SAME

BACKGROUND

The present invention relates generally to pad conditioners used to condition polishing pads. The polishing pads can be configured for polishing a variety of materials, including, for example, plastics, glasses, and semiconductor wafers. More particularly, the present invention relates to a pad conditioner with an undulated surface.

During manufacture, semiconductor wafers used in semiconductor fabrication typically undergo numerous processing steps, including deposition, patterning, and etching steps. Details of these manufacturing steps for semiconductor wafers are reported by Tonshoff et al., "Abrasive Machining of Silicon", published in the *Annals of the International Institution for Production Engineering Research*, (Volume 39/2/1990), pp. 621–635. In each manufacturing step, it is often necessary or desirable to modify or refine an exposed surface of the wafer in order to prepare the wafer for subsequent fabrication or manufacturing steps.

For example, after a deposition step, the deposited material or layer on a wafer surface generally needs further processing before additional deposition or subsequent processing occurs. In another example, after an etching step, there is often a need to deposit conducting or insulating materials in layers on the etched surface areas of a wafer.

At each step, it is often desirable to achieve a predetermined level of surface uniformity. It is also desirable to remove surface defects such as pits and scratches. Such surface irregularities may affect the performance of the semiconductor device or create problems during subsequent processing steps.

One method of modifying or refining exposed surfaces of a wafer involves treating the wafer surface with a slurry containing a plurality of loose abrasive particles dispersed in a liquid. Typically, this slurry is applied to a polishing pad and the wafer surface is then moved against the pad in order to remove or take material off of the wafer surface. The slurry may also contain agents that chemically react with the wafer surface. This type of process is commonly referred to as a chemical-mechanical planarization or polishing (CMP) process. A variation of the CMP process employs a fixed abrasive article as the polishing pad, typically with an abrasive-free working fluid.

One problem with CMP is that the process must be carefully monitored in order to achieve a desired wafer surface topography. The use history of the polishing pad, for example, may affect the polishing results. During CMP, the surface of polishing pads for abrasive-slurry type CMP operations become glazed, thus nonreceptive to accommodating or dispensing the abrasive slurry, and otherwise incapable of polishing at a satisfactory rate and uniformity. The polishing pad surface is conditioned so that it is maintained in a proper form for CMP.

Other processes also use polishing pads that require conditioning. For example, polishing pads for glass and plastic polishing may require conditioning. In certain applications, the polishing pads can contain abrasives. U.S. Pat. No. 5,958,794 (Bruxvoort et al.), for example, discloses a fixed abrasive article for polishing wafers.

The polishing pad is conditioned with an abrasive article commonly referred to as a pad conditioner. After repeated conditioning steps, the pad conditioner eventually becomes spent. The pad conditioner becomes spent when it becomes incapable of conditioning the polishing pad at a satisfactory rate and uniformity. Accordingly, the value of a pad conditioner is increased if its useful life can be extended.

After repeated conditioning operations, the polishing pad also becomes spent and needs to be replaced. During replacement of the polishing pad, the CMP apparatus is unavailable and productivity is reduced. A pad conditioner that is too aggressive and abrades the polishing pad too fast can compromise productivity. Most abrasive articles, including pad conditioners, are optimized for one process and one type of workpiece. For example, if a selected pad conditioner is too aggressive and abrades the polishing pad too rapidly, an alternate pad conditioner with a lower cut rate can be used in its place. Managing a supply of various pad conditioner types for various workpieces, however, introduces complexity to the manufacturing environment and increases inventory costs. Accordingly, the value of a pad conditioner is increased if it can be optimized for use in multiple processes and for a variety of workpieces.

SUMMARY

The present invention provides an abrasive article for conditioning a polishing pad. More particularly, the present invention relates to a pad conditioner with an undulated surface that can increase the useful life of the pad conditioner. The undulated surface also allows the pad to be modified for use with multiple processes and for a variety of polishing pads.

In one aspect, the present invention provides a pad conditioner having an abrasive disk and an undulating disk. The abrasive disk has an abrasive surface that conditions the polishing pad. The undulating disk has an undulated surface proximate the abrasive disk. The undulating disk has at least one raised portion and at least one recessed portion that create the undulated surface. The abrasive disk is releasably affixed to at least a portion of the recessed portion to form an undulated abrasive surface.

In another aspect, the present invention provides an undulating disk having an undulating plate and a backing plate. The materials and dimensions used for the undulating plate can be selected so that the abrasive disk is more flexible than the undulating disk.

In another aspect, the present invention provides an undulated pad conditioner with an abrasive surface that can be indexed. The abrasive disk can be rotated relative to the undulating disk to index the undulated abrasive surface. The abrasive disk can have a quantity of indexing holes in its substrate and the undulating disk can have a quantity of substrate mounting holes. The abrasive disk can be releasably affixed to the undulating disk with one or more removable fasteners. In certain embodiments, the quantity of indexing holes is at least two times the quantity of substrate mounting holes.

In another aspect, the present invention provides an undulating disk with a patterned undulated surface. The patterned undulated surface can have, for example, a stepped pattern.

Also provided are methods for conditioning a polishing pad. The methods include contacting the polishing pad with an abrasive article having an undulated abrasive layer. The abrasive article is moved relative to the polishing pad to modify the surface of the pad.

In another aspect of the present invention, methods are provided that include indexing the abrasive surface of the pad conditioner. The abrasive surface can be indexed by rotating the abrasive disk relative to the undulating disk to a second releasably affixed position.

The above summary is not intended to describe each disclosed embodiment or every implementation of the present invention. The figures and the detailed description that follow more particularly exemplify illustrative embodiments.

DETAILED DESCRIPTION

Throughout this application, the following definitions apply:

An "undulated" surface is a surface that is non-planar. The undulated surface includes raised portions and recessed portions. The undulated surface can have a pattern or be random.

A "patterned undulated surface" is an undulated surface with a discernable design or configuration. Pattern undulated surfaces include, for example, waves, spirals, and steps. A wave pattern is formed when the undulated surface transitions from raised portions to recessed portions in a sinusoidal curve like fashion. The sinusoidal curves are formed perpendicular to the surface and generally follow radii about the center of the surface. A step pattern is similar to a wave pattern except the raised and recessed portions have flat areas. A spiral pattern is formed when the raised surface forms a spiral about the center of the surface. A patterned undulated surface can include other patterns, including, for example, checkerboard, polka-dot, striped, and the like.

The term "offset" is used to refer to the distance between the plane at the center of a raised portion and the plane at the center of a recessed portion of an undulated surface. For example, if an undulated surface has a generally planar surface with two cylinders extending 2 mm above the planar surface such that the central axis of each cylinder is perpendicular to the planar surface, the offset for the undulated surface would be 2 mm. The offset can be measured at the surface of the undulating disk, described herein, or at the abrasive surface.

The term "polishing pad" is used to refer to a material, such as a polymeric sheet, foam, fabric, or a fixed abrasive article, that is used to modify the surface of a workpiece in a frictional polishing process. The polishing process usually reduces the depth of scratches or pits on the surface of the workpiece. Polishing pads are typically used with a working fluid and can be used with or without abrasive slurries. A pad conditioner modifies the surface of a polishing pad that in turn modifies the surface of a workpiece.

The present invention provides a pad conditioner having an undulated surface. Deforming the pad conditioner with an undulating disk creates the undulated surface. The undulating disk allows the user to adjust the abrading properties of the pad conditioner. For example, if the cut rate of the selected pad conditioner increases as the surface contact area of the selected pad conditioner and polishing pad increases, the pad conditioner can be deformed to reduce its cut rate. The type and extent of deformation of the pad conditioner adjusts the abrading properties of the pad conditioner. Conversely, in other configurations, the cut rate may increase as the pad conditioner transitions from having a substantially flat surface to having an undulated surface.

Figure 1:
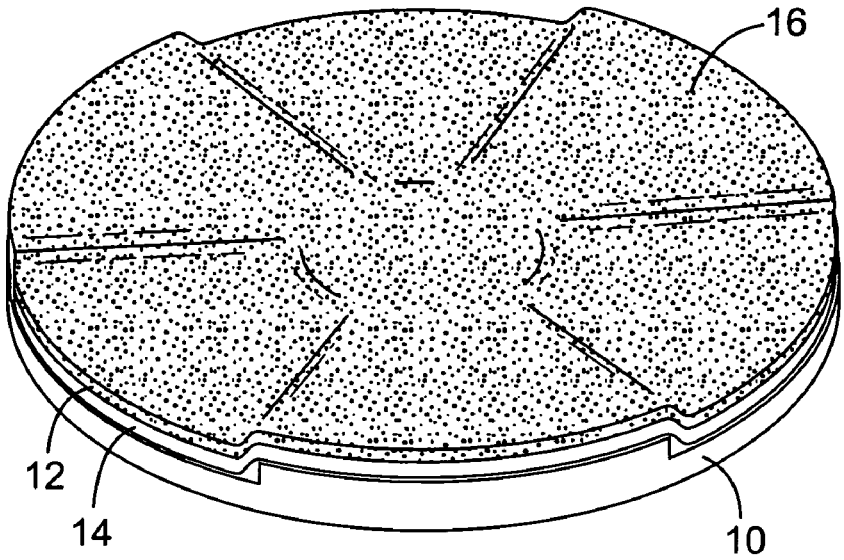
FIG. 1 is a perspective view of an exemplary pad conditioner.

FIG. 1 shows one embodiment of an undulated pad conditioner. As shown in FIG. 1, the undulated pad conditioner includes undulating disk 10, substrate 14, and abrasive layer 12. The abrasive layer 12 has an abrasive surface 16.

The abrasive layer 12 can be constructed to include a backing with an abrasive surface 16 affixed onto the backing. An abrasive layer 12 constructed with a backing may eliminate the need for substrate 14.

The abrasive surface 16 is a textured surface suitable for conditioning a polishing pad. The abrasive surface, for example, can include abrasive particles and a matrix material, such as described in U.S. Pat. No. 6,123,612 (Goers), incorporated herein by reference. Other techniques known in the art, including, for example, electroplating, sintering, and brazing can also be used to adhere the abrasive particles to a backing to create an abrasive surface.

The size and type of abrasive particles are selected based on the intended application. Suitable abrasive particles include, for example, fused aluminum oxide, ceramic aluminum oxide, heat treated aluminum oxide, silicon carbide, boron carbide, tungsten carbide, alumina zirconia, iron oxide, diamond (natural and synthetic), ceria, cubic boron nitride, garnet, carborundum, boron suboxide, and combinations thereof. In certain preferred embodiments, the abrasive particles have a Mohs hardness of at least about 8. In other embodiments, the Mohs hardness is at least about 9. In yet other embodiments, the Mohs hardness is at least about 10.

Abrasive particles useful in the present invention have an average size of at least about 3 micrometers. In certain embodiments, the abrasive particles have an average size of at least about 20 micrometers. In other embodiments, the abrasive particles have an average size of at least about 40 micrometers. In yet further embodiments, the abrasive particles have an average size of at least about 80 micrometers. Abrasive particles useful in the present invention have an average size of less than about 1000 micrometers. In certain embodiments, the abrasive particles have an average size less than about 600 micrometers. In other embodiments, the abrasive particles have an average size less than about 300 micrometers.

In certain embodiments, the abrasive particles may be in the form of abrasive agglomerates that comprise a plurality of individual abrasive particles bonded together to form a unitary particulate. The abrasive agglomerates may be irregularly shaped or may have a predetermined shape. The abrasive particles may further include a surface treatment, such as, for example, a coupling agent, or a metal or ceramic coating.

The matrix material used in the abrasive layer to affix the abrasive particles can include a metal, such as, for example, tin, bronze, silver, iron, and alloys or combinations thereof. The matrix material may also include other metals and metal alloys, including, for example, stainless steel, titanium, titanium alloys, zirconium, zirconium alloys, nickel, and nickel alloys. The substrate 36 can be made of any suitable material, such as, for example, stainless steel foil, nickel, or nickel-chromium-iron alloys available under the trade designation "INCONEL", available from McMaster-Carr Supply Co., Chicago, Ill.

In whatever form, the abrasive surface is constructed to grind, polish, or otherwise abrade the surface of a polishing pad. The surface is typically abraded with relative movement between the abrasive surface and the polishing pad to generate the friction required for the desired abrasive application.

Figure 2:
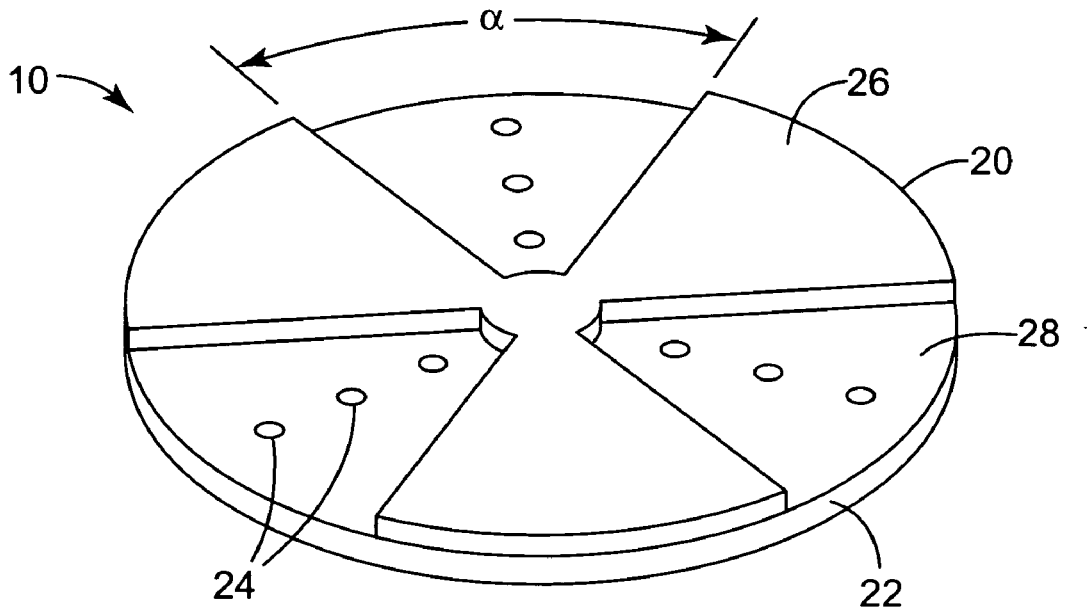
FIG. 2 is a perspective view of an exemplary undulating disk.

FIG. 2 shows a perspective view of an exemplary undulating disk 10. As shown in FIG. 2, the undulating disk 10 includes raised portions 26, recessed portions 28, an undulating plate 20, and a backing plate 22. The undulating plate 20 has three arms that extend out from the center separated by a void having an angle $\alpha$. The arms form the raised portions 26 of the undulating disk. The void areas of the undulating plate create the recessed portions 28. In certain preferred embodiments, the undulating disk has three arms connected by a circular area wherein $\propto$ is about 40 degrees. The undulating plate 20 and backing plate 22 can be separate pieces as shown in FIG. 2, or they can be integrated and formed as one piece as shown in FIG. 1.

In certain preferred embodiments, the raised portions 26 of the undulating disk 10 extend at least 0.5 mm above the recessed portions 28 to create an offset of at least 0.5 mm. Other embodiments have undulating disks with larger offsets, such as, for example, 0.75 mm or 1.0 mm. In certain embodiments, the undulating disk has offsets between 0.050 mm and 0.5 mm, including, for example, an offset of 0.25 mm.

The relative surface areas of the raised portions and the recessed portions of the undulating disk can vary. In certain preferred embodiments, the surface area of the raised portions comprises at least about 50 percent of the surface of the undulating disk. The surface area of the raised portions for some embodiments comprises at least about 33 percent of the surface of the undulating disk. In other embodiments, the surface area of the raised portions comprises at least 10 percent of the surface of the undulating disk. In certain preferred embodiments, the surface area of the raised portions comprises less than about 50 percent of the surface of the undulating disk. The surface area of the raised portions for some embodiments comprises less than about 66 percent of the surface of the undulating disk. In other embodiments, the surface area of the raised portions comprises less than about 90 percent of the surface of the undulating disk.

The raised portions 26 of the undulating disk 10 can have a pattern or be random. In certain preferred embodiments, the undulating disk has a step pattern as shown in FIG. 2. In other embodiments, the undulating disk has a sinusoidal wave pattern.

Figure 3:
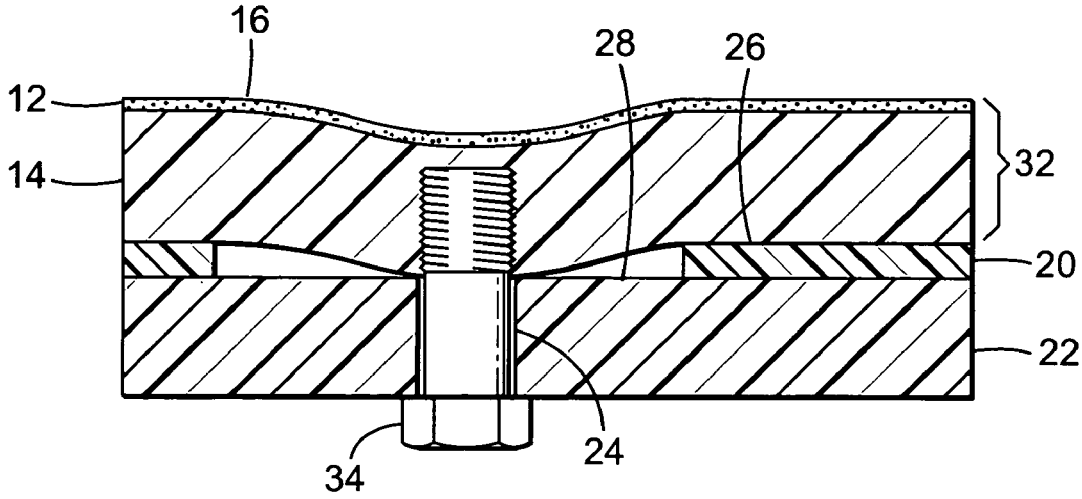
FIG. 3 is a cross-sectional side view of an exemplary undulating disk with an abrasive disk attached.

FIG. 3 is a cross-sectional side view of an exemplary undulating disk 10 with an abrasive disk 32 attached. As shown in FIG. 3, the abrasive disk 32 has a substrate 14 and an abrasive layer 12 having an abrasive surface 16. The backing plate 22 of the undulating disk 10 includes substrate mounting holes that allow removable fastener 34 to pass through. In certain preferred embodiments, the substrate 14 has threaded holes that align with the substrate mounting holes 24. The abrasive disk 32 is attached to the undulating disk with fastener 34. Fastener 34 is then used to deform the substrate 14 to create an undulated abrasive surface 16.

Loosening or tightening fastener 34 adjusts the offset of the abrasive surface. For example, if a greater offset is desired, fastener 34 can be tightened. Likewise, loosening fastener 34 will reduce the offset of the abrasive surface. The materials and dimensions selected for the abrasive disk 32 and the undulating disk 10 will affect the offset that can be achieved on the abrasive surface 16. In certain preferred embodiments, the substrate 14 is designed to be more flexible than the backing plate 22. For example, while the substrate 14 and the backing plate 22 can be made of similar material, the backing plate can be designed to be thicker (i.e. less flexible) than the substrate. Alternatively, the backing plate and the substrate can be made from different materials.

In certain embodiments, the undulating disk is made from metal, such as, for example, steel or aluminum. The undulating disk can also be made from other materials including, for example, plastic, rubber, or ceramic. The undulating disk can also be made from a combination of materials. For example, the backing plate may be made from a relatively stiff material, such as, for example, metal, and the undulating plate could be made from a relatively pliable material such as, for example, rubber.

In certain preferred embodiments, the substrate is made from polycarbonate. The substrate can also be made from other materials including, for example, filled and unfilled plastics such as epoxy, polysulfone, phenolics, polyacrylates, polymethacrylates, polyolefins, styrene, and combinations thereof.

The fastener 34 used for the embodiment shown in FIG. 3 is a bolt. Other fasteners capable of holding the abrasive disk to the undulating disk can also be used. The fastener can temporarily affix the abrasive disk to the undulating disk, such as with a removable threaded screw or bolt. Examples of temporary or removable fasteners include, for example, screws, bolts, pins, rivets, snaps, clamps, hook and loop systems, clips, and the like.

The orientation of the fasteners can be varied. For example, the embodiment shown in FIG. 3 orients that bolt such that the through hole is in the undulating disk and the threaded hole is in the abrasive disk. The orientation can be reversed such that the through holes for the bolt are in the abrasive layer and the threaded holes are in the undulating disk.

Figure 4:
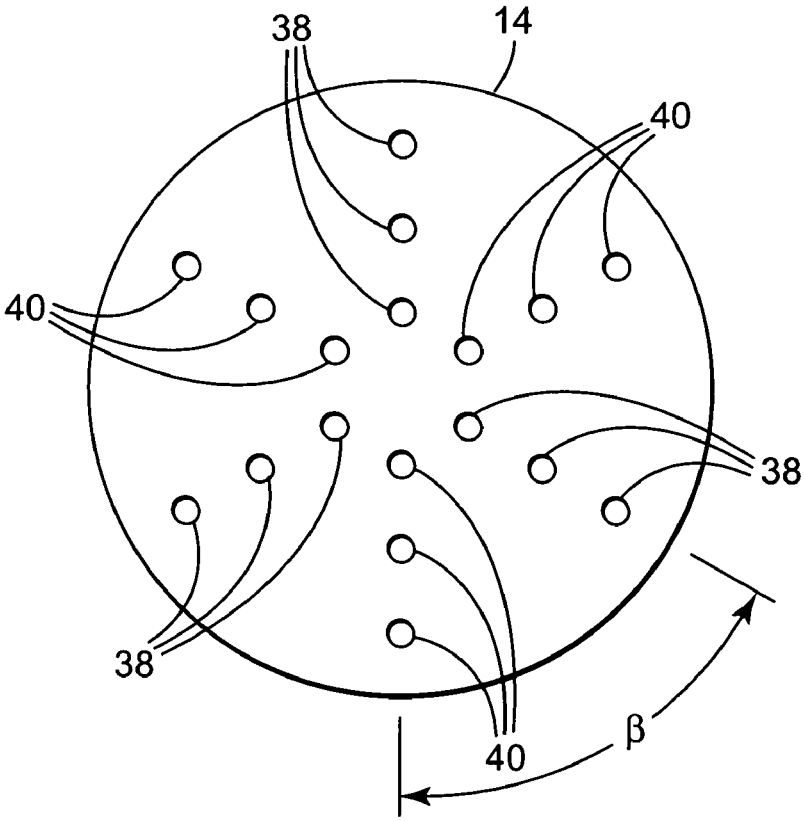
FIG. 4 is a bottom side view of an exemplary abrasive disk having two sets of indexing holes.

FIG. 4 is a bottom side view of an exemplary substrate of an abrasive disk. As shown in FIG. 4, the substrate 14 has a first set of indexing holes 38 and a second set of indexing holes 40. The first and second set of indexing holes 38, 40 are offset about the center of the abrasive disk by angle $\beta$. The indexing holes allow the abrasive disk to be affixed to the undulating disk in more than one position. Each set of indexing holes 38, 40 is configured to align with the substrate mounting holes 24. For example, the abrasive disk shown in FIG. 4 could be used with an undulating disk similar to FIG. 2 having nine substrate mounting holes. The nine substrate mounting holes are capable of fastening the abrasive disk using either the first set of indexing holes 38 or the second set of indexing holes 40. After a period of use, the abrasive disk can be removed and subsequently reattached to the undulating disk using the alternate set of indexing holes to expose unused portions of the abrasive surface. In this manner, the useful life of the abrasive disk is extended.

Other multiples of indexing holes can also be used. For example, if the undulating disk has four recessed portions each having one substrate mounting hole, for a total of four holes, the abrasive disk could have three or more sets of indexing holes, each set having four holes. Alternatively, the abrasive disk can be indexed by varying the fasteners between the recessed portions. In this manner, the abrasive surface is not rotated relative to the undulating disk to index the abrasive surface. For example, if an undulating disk has eight recessed portions, the offset of the abrasive surface could be adjusted using fasteners in only four of the recessed portions. The abrasive surface could then be indexed by moving the fasteners to the remaining four recessed portions.

In certain preferred embodiments, the abrasive surface can be indexed without removing the pad conditioner from the conditioner assembly. This can be accomplished by any means known in the art including radially slotted mounting holes in the undulating disk. In other embodiments, the abrasive surface can be indexed while the conditioner pad is conditioning the polishing pad. This can be accomplished by any means known in the art including, for example, coaxial shafts for the undulating disk and the abrasive disk or a planetary gear between the undulating disk and the abrasive disk. In such embodiments, the abrasive disk can be affixed to the undulating disk using a series of radial grooves that engage fasteners that can slide within the groove. The grooves can be positioned on the surface of the undulating disk with the corresponding sliding fasteners affixed to the abrasive disk.

Advantages and other embodiments of this invention are further illustrated by the following examples, but the particular materials and amounts thereof recited in these examples, as well as other conditions and details, should not be construed to unduly limit this invention. For example, the undulating disk can be one integral body or be a combination of an undulating plate and backing plate. Further, the examples condition polycarbonate instead of a polishing pad to provide a test piece with a more readily measured cut rate and cumulative cut. The examples show that an undulated pad conditioner can be used to adjust the material removal rate and reduce the variability in cut rate over time of the pad conditioner. All parts and percentages are by weight unless otherwise indicated.

EXAMPLE 1A

An abrasive disk was prepared by attaching an abrasive material to a substrate using double-sided tape. The abrasive material was "472 L, 40 $\mu$m, silicon carbide microfinishing film" available from 3M Co., St. Paul, Minn., cut into an 83 mm diameter disk with a 19 mm center hole. The substrate was a 6.3 mm thick, 83 mm diameter polycarbonate disk. The substrate was drilled and tapped with six 10-24 UNC threads placed equally distant apart from one another on a 30 mm diameter.

An undulating disk was prepared by placing an undulating plate onto a backing plate. The undulating plate was a 0.6 mm thick sheet of polypropylene cut to a 85 mm diameter. The undulating plate was configured with three arms similar to undulating plate 20 shown in FIG. 2. The angle $\alpha$ was 40 degrees. The backing plate was a 1.27 mm aluminum plate cut to a 100 mm diameter. Six through holes were drilled in the backing plate on a 30 mm diameter to match the threaded holes in the substrate.

The abrasive disk was attached to the undulating disk using three screws. The screws were used to pull the substrate of the abrasive disk into contact with the backing plate of the undulating disk at the three recessed portions.

A Gerber Apex lens polishing machine, available from Gerber-Coburn, Muskogee, Okla., was used for testing the abrasion performance. A 12 mm thick polycarbonate disk was used as the test workpiece. Polycarbonate was used instead of a polishing pad to provide a test piece with a more readily measured cut rate and cumulative cut. The undulated pad conditioner was tested by measuring the cumulative cut of the workpiece. The results are shown in Table 1 and FIGS. 5 and 6.

EXAMPLE 1B

For Example 1B, the abrasive disk used for Example 1A was rotated (i.e. indexed) about the undulating disk 60 degrees and re-tested using the same test as Example 1A. After rotation, the three screws were located in the same through holes of the undulating disk of Example 1A and the alternate threaded holes of the abrasive disk. The screws were used to pull the substrate of the abrasive disk into contact with the backing plate of the undulating disk at the three recessed portions. The undulated pad conditioner was tested by measuring the cumulative cut of the workpiece. The results are shown in Table 1 and FIGS. 5 and 6.

COMPARATIVE EXAMPLE 1

Comparative Example 1 was prepared in the same manner as Example 1A except the undulating plate was removed to eliminate the undulating surface. Six screws were used to hold the substrate of the abrasive layer to the backing plate. The flat pad conditioner was tested by measuring the cumulative cut of the workpiece. The results are shown in Table 1 and FIGS. 5 and 6.

TABLE 1

| Cumulative Cut ($\mu$m) versus Time (seconds) | | | | |
|---|---|---|---|---|
| Time | Comparative Example 1 | Example 1A | Example 1B | Sum of Example 1 (A + B) |
| 0 | 0 | 0 | 0 | 0 |
| 10 | 25 | 7 | 1 | 8 |
| 20 | 53 | 7 | 9 | 16 |
| 30 | 82 | 17 | 16 | 33 |
| 40 | 104 | 29 | 28 | 57 |
| 60 | 144 | 59 | 46 | 105 |
| 80 | 179 | 74 | 64 | 138 |
| 100 | 208 | 94 | 84 | 178 |
| 120 | 236 | 107 | 104 | 211 |
| 160 | 285 | 155 | 144 | 299 |
| 200 | 328 | 180 | 172 | 352 |
| 240 | 368 | 205 | 201 | 406 |
| 280 | 402 | 234 | 227 | 461 |
| 360 | 463 | 279 | 281 | 560 |
| 420 | 515 | 316 | 320 | 636 |
| 500 | 563 | 349 | 360 | 709 |
| 580 | 605 | 379 | 390 | 769 |

Figure 5:
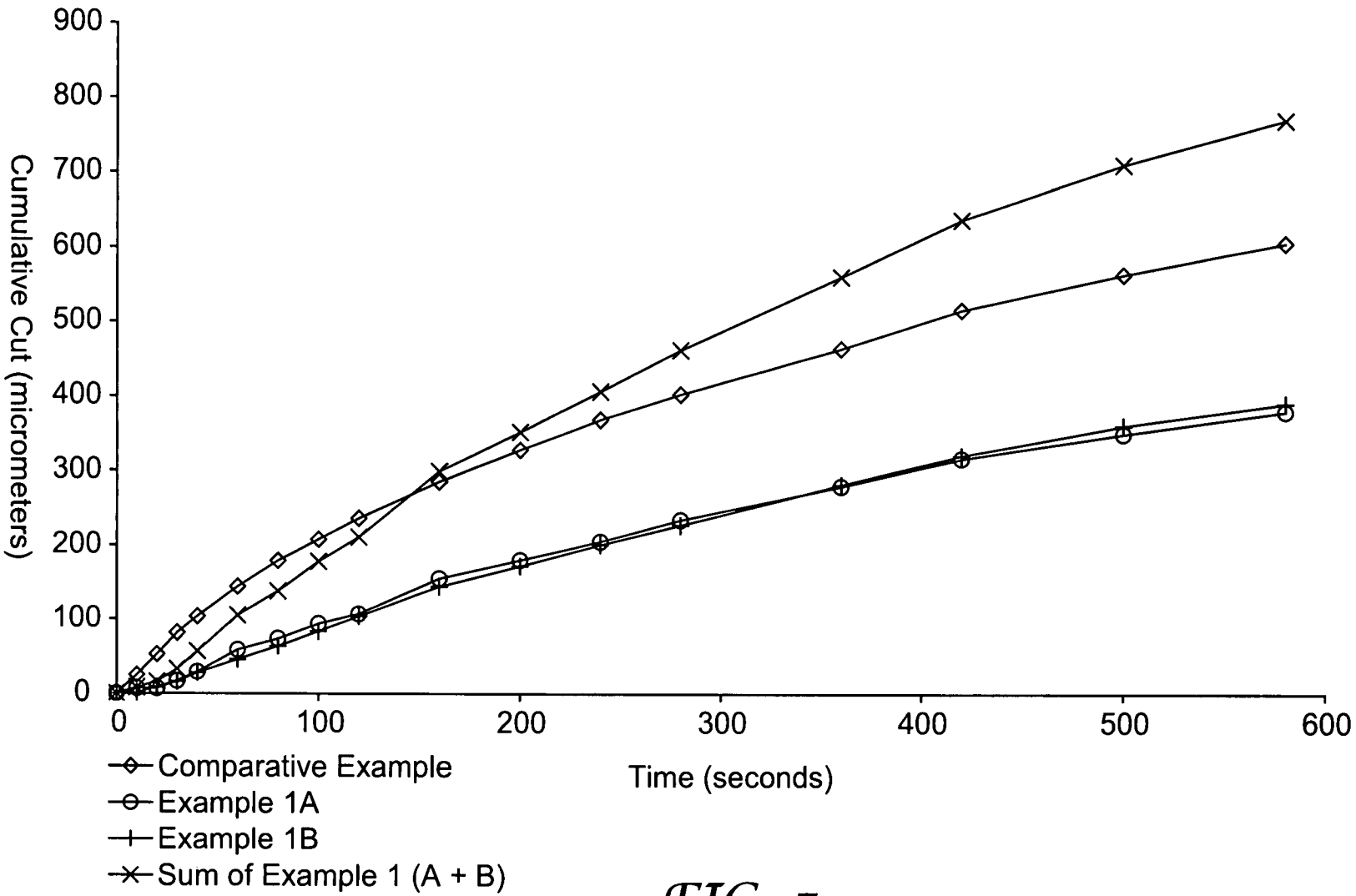
FIG. 5 is a graph showing cumulative cut rates over time.
Figure 6:
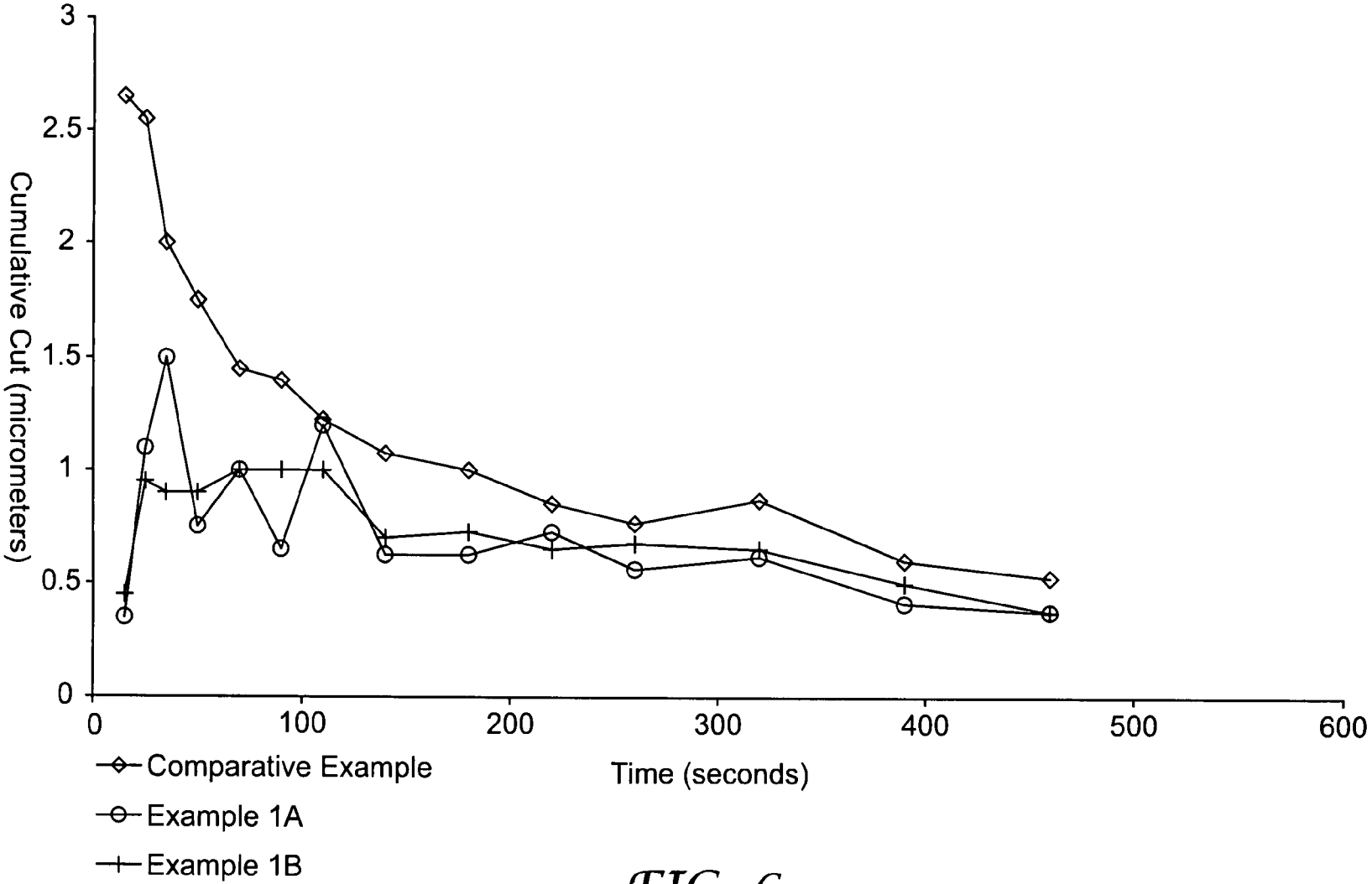
FIG. 6 is a graph showing cut rates versus duration of use.

As shown in Table 1 and FIGS. 5 and 6, the undulated pad conditioner generally had a lower cut rate than the flat pad conditioner and the cut rate of the undulated pad conditioner was more constant over time.

EXAMPLE 2A

Example 2A was prepared and tested in the same fashion as Example 1A except that the abrasive disk was prepared by attaching a sintered abrasive layer to the polycarbonate substrate. The sintered abrasive layer was prepared by removing the sintered layer from an A160, 3M 4980-6 pad conditioner available from 3M Co., St. Paul, Minn. The sintered layer was removed after heating the pad conditioner on a hot plate until the epoxy attaching the sintered layer softened. The sintered abrasive was then attached to the polycarbonate substrate with epoxy.

The undulated pad conditioner was tested by measuring the cumulative material removed from the polycarbonate workpiece. The results are shown in Table 2.

EXAMPLE 2B

For Example 2B, the abrasive disk from Example 2A was rotated (i.e. indexed) about the undulating disk 60 degrees and re-tested using the same test as Example 2A. After rotation, the three screws were located in the same through holes of the undulating disk of Example 2A and the alternate threaded holes of the abrasive disk. The screws were used to pull the substrate of the abrasive disk into contact with the backing plate of the undulating disk at the three recessed portions. The undulated pad conditioner was tested by measuring the cumulative cut of the workpiece. The results are shown in Table 2.

COMPARATIVE EXAMPLE 2

Comparative Example 2 was prepared in the same manner as Example 2A except the undulating plate was removed to eliminate the undulating surface. Six screws were used to hold the substrate of the abrasive layer to the backing plate. The flat pad conditioner was tested by measuring the cumulative material removed from the workpiece. The results are shown in Table 2.

TABLE 2

Cumulative Cut Millimeters versus Time (seconds)

| Time | Comparative Example 2 | Example 2A | Example 2B |
|---|---|---|---|
| 0 | 0 | 0 | 0 |
| 30 | 0.05 | 0.09 | 0.06 |
| 60 | 0.10 | 0.14 | 0.13 |
| 90 | 0.16 | 0.21 | 0.20 |
| 120 | 0.20 | 0.27 | 0.27 |
| 150 | 0.25 | 0.34 | 0.33 |
| 180 | 0.30 | 0.41 | 0.39 |
| 210 | 0.34 | 0.48 | 0.45 |
| 240 | 0.40 | 0.54 | 0.53 |
| Average cut per 30 seconds | 0.23 | 0.31 | 0.30 |

As shown in Table 2, the undulated pad conditioners had a higher average cut rate than the flat pad conditioner.

It is to be understood that even in the numerous characteristics and advantages of the present invention set forth in above description and examples, together with details of the structure and function of the invention, the disclosure is illustrative only. Changes can be made to detail, especially in matters of shape, size and arrangement of the undulated pad conditioner assembly and methods of use within the principles of the invention to the full extent indicated by the meaning of the terms in which the appended claims are expressed and the equivalents of those structures and methods. For example, the undulated pad conditioner can be used for conditioning a fixed abrasive article, including three-dimensional abrasive articles and conventional lapping materials made from abrasive slurries.

What is claimed is:

1. A pad conditioner comprising:

an abrasive disk comprising an abrasive surface and a second surface opposite said abrasive surface; and an undulating disk having an undulated surface proximate said second surface of said abrasive disk, said undulating disk comprising at least one raised portion and at least one recessed portion;

wherein said abrasive disk is releasably affixed to at least a portion of said recessed portion to form an undulated abrasive surface.

2. The pad conditioner of claim 1 wherein said pad conditioner is a chemical-mechanical planarization pad conditioner.

3. The pad conditioner of claim 2 wherein said undulating disk further comprises an undulating plate and a backing plate.

4. The pad conditioner of claim 2 wherein said abrasive disk further comprises a substrate and an abrasive layer.

5. The pad conditioner of claim 4 wherein said substrate is more flexible than said undulating disk.

6. The pad conditioner of claim 5 wherein said substrate is formed from polycarbonate.

7. The pad conditioner of claim 4 wherein said substrate is releasably affixed to said recessed area with at least one removable fastener.

8. The pad conditioner of claim 7 wherein said substrate further comprises a quantity of indexing holes, said undulating disk further comprises a quantity of substrate mounting holes, and said substrate mounting holes and said indexing holes are configured for said removable fastener.

9. The pad conditioner of claim 8 wherein said quantity of indexing holes is at least two times said quantity of substrate mounting holes.

10. The pad conditioner of claim 2 wherein said abrasive disk comprises a sintered abrasive layer.

11. The pad conditioner of claim 2 further comprising at least three said recessed portions.

12. The pad conditioner of claim 11 wherein said undulating disk comprises a patterned undulated surface.

13. The pad conditioner of claim 12 wherein said patterned undulated surface has a step pattern.

14. The pad conditioner of claim 12 wherein said patterned undulated surface comprises an offset in range from about 0.25 mm to about 0.75 mm.

15. The pad conditioner of claim 12 wherein said raised portion is in a range from about 33 percent to about 66 percent of the area of said patterned undulated surface.

16. A method of conditioning a polishing pad comprising:

contacting said pad with an abrasive article comprising an abrasive disk and an undulating disk that forms an undulated abrasive layer; and moving said abrasive article relative to said pad to modify a surface of said pad.

17. The method of claim 16 wherein said undulated abrasive layer comprises an offset in a range from about 0.25 mm to about 0.75 mm.

18. The method of claim 16 further comprising the step of indexing said abrasive article by rotating said abrasive disk relative to said undulating disk.

19. The method of claim 16 further comprising the step of adjusting the offset of said undulated abrasive layer of said abrasive disk.

20. The method of claim 16 wherein said abrasive disk is affixed to said undulating disk with at least one removable fastener.

* * * * *